US009302282B2

(12) United States Patent
Bertin et al.

(10) Patent No.: US 9,302,282 B2
(45) Date of Patent: Apr. 5, 2016

(54) FLUID PRODUCT DISPENSER

(75) Inventors: Romain Bertin, Evreux (FR); Francis Moreau, Sotteville les Rouen (FR); Patrick Muller, Saint Aubin sur Gaillon (FR)

(73) Assignee: APTAR FRANCE SAS, Le Neubourg (FR)

( * ) Notice: Subject to any disclaimer, the term of this patent is extended or adjusted under 35 U.S.C. 154(b) by 25 days.

(21) Appl. No.: 14/232,508

(22) PCT Filed: Aug. 1, 2012

(86) PCT No.: PCT/FR2012/051818

§ 371 (c)(1),
(2), (4) Date: Jan. 13, 2014

(87) PCT Pub. No.: WO2013/017802

PCT Pub. Date: Feb. 7, 2013

(65) Prior Publication Data

US 2014/0144939 A1 May 29, 2014

(30) Foreign Application Priority Data

Aug. 1, 2011 (FR) ..... 11 57051

(51) Int. Cl.
*B67D 7/70* (2010.01)
*B05B 7/24* (2006.01)
*B05B 11/00* (2006.01)

(52) U.S. Cl.
CPC ..... *B05B 7/2486* (2013.01); *B05B 11/0081* (2013.01); *B05B 11/3084* (2013.01); *B05B 11/0016* (2013.01)

(58) Field of Classification Search
CPC ..... B65D 81/3222; B65D 81/3227; B65D 81/325; B65D 81/3255; B65D 81/32; B05B 11/3084; B05B 11/3085; B05B 11/3081; B05B 11/0016; B05B 7/2486
USPC ..... 222/135, 136, 132, 145.5, 129, 222/321.1–321.9
See application file for complete search history.

(56) References Cited

U.S. PATENT DOCUMENTS 2,941,696 A * 6/1960 Homm ..... 222/136
4,949,874 A * 8/1990 Fiedler et al. ..... 222/135

(Continued)

FOREIGN PATENT DOCUMENTS

CN 2 545 134 Y 4/2003
FR 2 793 479 A1 11/2000
WO WO 01/26821 A1 * 4/2001

OTHER PUBLICATIONS

English translation of the International Preliminary Report on Patentability for PCT/FR2012/051818.

*Primary Examiner* — Lien Ngo
(74) *Attorney, Agent, or Firm* — Sughrue Mion, PLLC

(57) ABSTRACT

A fluid dispenser comprising two reservoirs (R1, R2), two pumps (P1, P2), and two pushers (B1, B2), namely a first pusher (B1) for actuating a first pump (P1) that is connected to a first reservoir (R1) containing a first fluid (F1), and a second pusher (B2) for actuating a second pump (P2) that is connected to a second reservoir (R2) containing a second fluid (F2), the dispenser further comprising a third pusher (B3) for dispensing a mixture of the first and second fluids (F1, F2), the first fluid (F1) being dispensed through a first dispenser orifice (O1), and the second fluid (F2) being dispensed through a second dispenser orifice (O2), the fluid dispenser being characterized in that the mixture of the two fluids (F1, F2) is dispensed through a third dispenser orifice (O3) that is formed by the third pusher (B3).

11 Claims, 1 Drawing Sheet

(56) References Cited

U.S. PATENT DOCUMENTS

| | | | | |
|---|---|---|---|---|
| 5,881,918 | A * | 3/1999 | Eichler | B05B 11/3084 222/135 |
| 5,967,372 | A * | 10/1999 | Favre | 222/137 |
| 6,135,323 | A * | 10/2000 | Chen et al. | 222/135 |
| 6,604,655 | B1 * | 8/2003 | Lee | 222/135 |
| 6,672,483 | B1 * | 1/2004 | Roy | 222/145.1 |
| 6,968,982 | B1 | 11/2005 | Burns | |
| 7,686,191 | B1 * | 3/2010 | Burns | 222/182 |
| 8,596,498 | B2 * | 12/2013 | Werner et al. | 222/136 |
| 2005/0127100 | A1 | 6/2005 | Reggiani | |
| 2007/0267446 | A1 * | 11/2007 | Pressler | A47K 10/04 222/192 |

* cited by examiner

FLUID PRODUCT DISPENSER

CROSS REFERENCE TO RELATED APPLICATIONS

This application is a National Stage of International Application No. PCT/FR2012/051818 filed Aug. 1, 2012, claiming priority based on French Patent Application No. 1157051 filed Aug. 1, 2011, the contents of all of which are incorporated herein by reference in their entirety.

The present invention relates to a fluid dispenser comprising two reservoirs, two pumps, and two pushers, namely a first pusher for actuating a first pump that is connected to a first reservoir containing a first fluid, and a second pusher for actuating a second pump that is connected to a second reservoir containing a second fluid. Advantageous fields of application of the present invention are the fields of perfumery, cosmetics, and pharmacy.

In the prior art, dual-type dispensers are already known comprising two reservoirs, two pumps, and a common pusher making it possible to actuate the two pumps simultaneously. Apportioning systems are also known that make it possible to vary the doses of fluid dispensed by the two pumps. Thus, by pressing on the common pusher, it is possible to dispense fluid from the first pump only, fluid from the second pump only, or a mixture of varying proportions of the fluids from both pumps simultaneously.

Document FR 2 793 479 describes a dual-type dispenser including two pushers that do not have a dispenser orifice, and a common pusher that acts simultaneously on both pushers and that forms a single common dispenser orifice. Document CN 2 545 134 describes a dual-type dispenser including two pushers that do not have a dispenser orifice, and a common pusher that acts simultaneously on both pushers, but that does not define a dispenser orifice.

An object of the present invention is to define another type of dual dispenser having two reservoirs and two pumps, but that is simpler for the user to use. It must be very simple for the user to dispense the first fluid only, or the second fluid only, or a mixture of both fluids.

To do this, the present invention proposes a fluid dispenser comprising two reservoirs, two pumps, and two pushers, namely a first pusher for actuating a first pump that is connected to a first reservoir containing a first fluid, and a second pusher for actuating a second pump that is connected to a second reservoir containing a second fluid, the dispenser further comprising a third pusher for dispensing a mixture of the first and second fluids, the first fluid being dispensed through a first dispenser orifice, and the second fluid being dispensed through a second dispenser orifice, the fluid dispenser being characterized in that the mixture of the two fluids is dispensed through a third dispenser orifice that is formed by the third pusher.

A user desiring a dose of the first fluid presses on the first pusher, a user desiring a dose of the second fluid presses on the second pusher, and a user desiring a dose of the first and second fluids in combination presses on the third pusher.

In another advantageous embodiment, the third pusher is mounted on a third pump that is connected to the first and second reservoirs. Actuation of the third pusher is thus totally independent of actuation of the first two pushers. In an embodiment, a buffer mixing reservoir is interposed between the third pump and the first and second reservoirs. Advantageously, the buffer reservoir is connected to the first and second reservoirs via two ducts, each fitted with a respective check valve, the fluids being sucked by the third pump into the buffer reservoir through the ducts. In another embodiment, the third pump includes two dip tubes that extend in the first and second reservoirs respectively. In the two embodiments, the actuation of the third pusher enables the third pump to take fluid either from the first two reservoirs directly, or else indirectly through the buffer reservoir.

In another advantageous aspect of the present invention, the first and second pumps each define an internal vent passage that is opened by actuating their respective pushers, the third pusher pressing lightly at the end of its stroke on the first and second pushers so as to open the internal vent passages of the first and second pumps. Advantageously, the third pusher includes a collar that projects outwards above the first and second pushers, the axial distance between the collar and the first and second pushers being a little less than the stroke of the third pusher. Thus, by actuating the third pusher, the first and second reservoirs are vented.

One of the principles of the invention resides in implementing a third pusher with a third dispenser orifice that makes it possible to dispense a mixture of the fluids contained in the two reservoirs. The third pusher may act directly on the first two pushers or it may actuate a third pump that is connected directly or indirectly to the two reservoirs.

The invention is described more fully below with reference to the accompanying drawing which shows three embodiments of the invention by way of non-limiting example.

Figure 1:
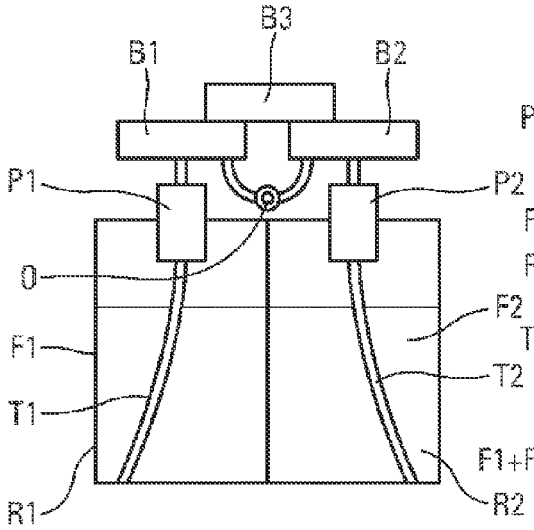
FIG. 1 is a very diagrammatic view showing a dispenser of the prior art.
Figure 2:
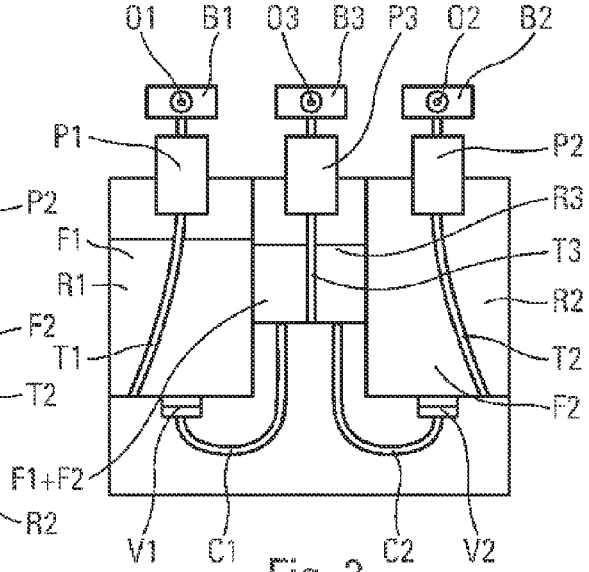
FIGS. 2 and 3 are very diagrammatic views showing two embodiments of the present invention respectively.
Figure 3:
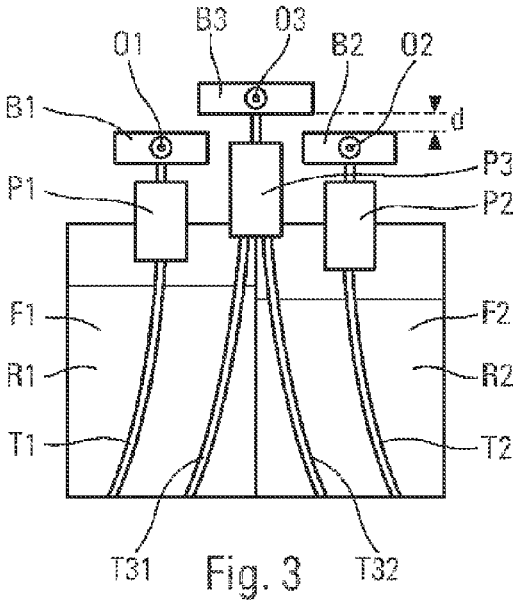

In the three embodiments in FIGS. 1 to 3, the dispensers include a first reservoir R1 containing a first fluid F1, and a second reservoir R2 containing a second fluid F2. The dispensers also include a first pump P1 that is associated with the first reservoir R1, and a second pump P2 that is associated with the second reservoir R2. The first pump P1 is provided with a first pusher B1, and the second pump P2 is provided with a second pusher B2. The pumps P1 and P2 are also provided with respective dip tubes T1, T2 that extend in the reservoirs R1 and R2 respectively, so as to convey the fluid to the pumps P1, P2. Thus, when the user presses on the first pusher B1, fluid F1 coming from the first reservoir R1 is conveyed through the dip tube T1 to the pump P1 and on to a dispenser orifice. The same applies for the pusher B2, which makes it possible, when actuated, to dispense the second fluid F2 via its dispenser orifice.

In the three embodiments, the dispenser is provided with a third pusher B3 that makes it possible to dispense a mixture of the first and second fluids F1, F2.

In the first embodiment of FIG. 1 that shows the prior art, the third pusher T3 acts directly on the first and second pushers B1, B2 such that a mixture of the two fluids F1, F2 is dispensed at the dispenser orifice O that is common to all three pushers B1, B2, B3. Although not shown, the dispenser of the first embodiment could incorporate three distinct dispenser orifices for the three pushers respectively. It should be clearly understood that the actuation of the first pusher B1 leaves the two other pushers B2, B3 stationary. The same applies for the second pusher B2. In contrast, when the third pusher B3 is actuated, it takes the first two pushers B1, B2 with it.

In the second embodiment of the invention of FIG. 2, the third pusher B3 is mounted on a third pump P3 that is fitted with a third dip tube T3 that extends inside a buffer mixing reservoir R3 that is distinct from the reservoirs R1 and R2. The buffer reservoir R3 is then connected to the first reservoir R1 via a first duct C1 that is provided with a check valve V1. In symmetrical manner, the buffer reservoir R3 is also connected to the second reservoir R2 via a second duct C2 that is fitted with a check valve V2. By way of example, the valves V1, V2 may be mounted on the reservoirs R1, R2 respectively. It should also be observed that each pusher B1, B2, and B3 is provided with a respective dispenser orifice O1, O2, or O3. Thus, a user desiring to dispense a dose of the first fluid F1 presses on the first pusher B1. Similarly, a user desiring to dispense a dose of fluid F2 presses on the second pusher B2. And a user desiring to dispense a mixture of the two fluids F1, F2 presses on the third pusher B3, which pusher actuates the pump P3 that takes a mixture of fluid already present in the buffer reservoir R3. The mixture of fluids F1+F2 present in the buffer reservoir R3 cannot return to the reservoirs R1 and R2 as a result of the presence of the two check valves V1, V2. By actuating the pusher B3, the pump P3 can draw up the mixture of fluids F1+F2 in the reservoir R3, thereby causing fluid F1 from the reservoir R1 and fluid F2 from the reservoir R2 to be sucked through the two ducts C1 and C2 respectively.

In the third embodiment of the invention of FIG. 3, the third pusher B3 incorporates a dispenser orifice O3 and is mounted on a third pump P3 that is fitted with two dip tubes, namely a dip tube T31 that extends into the first reservoir R1, and a second dip tube T32 that extends into the second reservoir R2. Operating the dispenser is very simple: by pressing on the pusher B1 or B2, the dispenser dispenses a single fluid F1 or F2, and by pressing on the pusher B3, the dispenser dispenses a mixture of the two fluids F1, F2 through the dip tubes T31, T32 and the pump P3.

Figure 4:
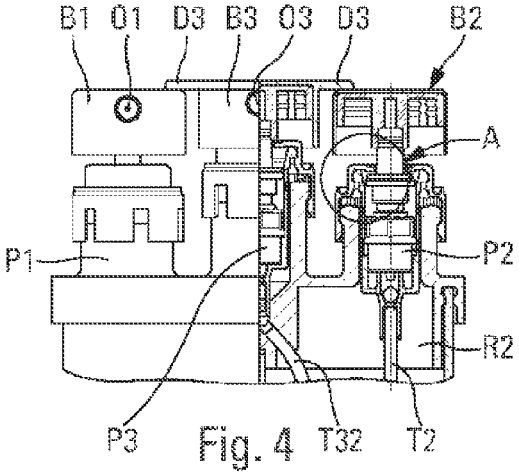
FIG. 4 is a more detailed view of the third embodiment with the third pusher depressed, thereby enabling the first two reservoirs to be vented.
Figure 5:
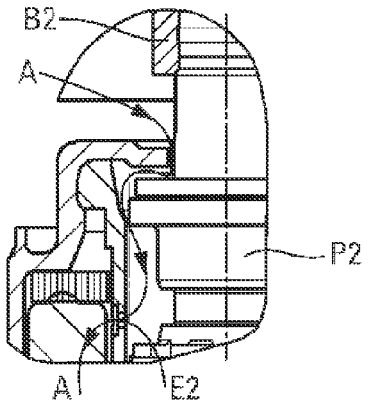
FIG. 5 is a larger-scale view of a detail A of FIG. 4 enabling the path of the vent air to be seen.

In a particularly advantageous aspect of the invention, the actuation of the third pusher B3 may cause the two reservoirs R1, R2 to be vented through respective vent passages of the pumps P1, P2. In FIG. 4, the pusher B3 is shown in its fully depressed position, and it can be seen that it includes a collar D3 that comes into bearing contact against the pushers B1 and B2 in such a manner as to depress them a little. This is possible by arranging the third pusher B3 such that the distance d visible in FIG. 3 between it and the two other pushers is slightly less than the total stroke of the pusher B3. Thus, at the end of stroke of the pusher B3, the collar D3 comes to bear simultaneously against the other two pushers B1, B2. FIG. 5 shows a detail of FIG. 4 in which there can be seen the vent passage that enables outside air to penetrate into the reservoirs R1 and R2 during each actuation, and in particular during actuation of the third pusher B3. In entirely conventional manner, in the rest position, the vent passage is shut off from the pump by a piston that slides inside a slide cylinder that is defined by the pumps. The invention thus provides a dual-type dispenser, but it includes three distinct pushers with three respective dispenser orifices, making it possible to dispense the first fluid, the second fluid, or a mixture of the two fluids respectively.

The invention claimed is:

1. A fluid dispenser comprising two reservoirs, two pumps, and two pushers, namely a first pusher for actuating a first pump that is connected to a first reservoir containing a first fluid, and a second pusher for actuating a second pump that is connected to a second reservoir containing a second fluid, the dispenser further comprising a third pusher for dispensing a mixture of the first and second fluids, the first fluid being dispensed through a first dispenser orifice, and the second fluid being dispensed through a second dispenser orifice, wherein the mixture of the two fluids is dispensed through a third dispenser orifice that is formed by the third pusher; and wherein the first pusher is distinct from and independently actuatable with respect to the second pusher; and wherein the third pusher is mounted on a third pump that is connected to the first and second reservoirs.

2. The fluid dispenser according to claim 1, wherein a buffer mixing reservoir is interposed between the third pump and the first and second reservoirs such that the third pump is connected to the first and second reservoirs via the buffer mixing reservoir.

3. The fluid dispenser according to claim 2, wherein the buffer reservoir is connected to the first and second reservoirs via two ducts, each fitted with a respective check valve, the fluids being sucked by the third pump into the buffer reservoir through the ducts.

4. The fluid dispenser according to claim 1, wherein the third pump includes two dip tubes that extend in the first and second reservoirs respectively.

5. The fluid dispenser according to claim 1, wherein the first and second pumps each define an internal vent passage that is opened by actuating their respective pushers, the third pusher pressing lightly at the end of its stroke on the first and second pushers so as to open the internal vent passages of the first and second pumps.

6. The fluid dispenser according to claim 5, wherein the third pusher includes a collar that projects outwards above the first and second pushers, the axial distance between the collar and the first and second pushers being a little less than the stroke of the third pusher.

7. The fluid dispenser according to claim 1, wherein the first and second pumps each define an internal vent passage that is opened by actuating their respective pushers, the third pusher pressing lightly at the end of its stroke on the first and second pushers so as to open the internal vent passages of the first and second pumps.

8. The fluid dispenser according to claim 2, wherein the first and second pumps each define an internal vent passage that is opened by actuating their respective pushers, the third pusher pressing lightly at the end of its stroke on the first and second pushers so as to open the internal vent passages of the first and second pumps.

9. The fluid dispenser according to claim 3, wherein the first and second pumps each define an internal vent passage that is opened by actuating their respective pushers, the third pusher pressing lightly at the end of its stroke on the first and second pushers so as to open the internal vent passages of the first and second pumps.

10. The fluid dispenser according to claim 4, wherein the first and second pumps each define an internal vent passage that is opened by actuating their respective pushers, the third pusher pressing lightly at the end of its stroke on the first and second pushers so as to open the internal vent passages of the first and second pumps.

11. A fluid dispenser comprising:

a first reservoir in communication with a first pump for dispensing a first fluid into the atmosphere from the first reservoir through a first orifice, the first pump actuated by a first pusher;

a second reservoir in communication with a second pump for dispensing a second fluid into the atmosphere from the second reservoir through a second orifice, the second pump actuated by a second pusher, the second pusher is distinct from and independently actuatable with respect to the first pusher;

a third pump actuated by a third pusher for dispensing through a third orifice a mixture of the first fluid and the second fluid received from the first reservoir and the second reservoir, respectively, the third pusher is distinct from and independently actuatable with respect to the first pusher and the second pusher; and wherein the fluid dispenser further comprises a third reservoir in communication with the third pump and containing the mixture of the first fluid and the second fluid received from the first reservoir and the second reservoir through respective fluid conduits.

* * * * *